US009612562B2

(12) United States Patent
Seike et al.

(10) Patent No.: US 9,612,562 B2
(45) **Date of Patent: *Apr. 4, 2017**

(54) UNIT PULLING-OUT MECHANISM AND IMAGE RECORDING APPARATUS

(71) Applicant: SHARP KABUSHIKI KAISHA, Osaka-shi, Osaka (JP)

(72) Inventors: Toshihiko Seike, Nara (JP); Toshiki Takiguchi, Yamatokoriyama (JP); Junya Masuda, Nara (JP); Hiroyuki Murai, Yamatokoriyama (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/633,699

(22) Filed: Feb. 27, 2015

(65) Prior Publication Data

US 2015/0168905 A1 Jun. 18, 2015

Related U.S. Application Data

(63) Continuation of application No. 11/819,031, filed on Jun. 25, 2007, now Pat. No. 8,995,879.

(30) Foreign Application Priority Data

Jun. 27, 2006 (JP) ..... 2006-176745

(51) Int. Cl.

| | |
|---|---|
| ***G03G 21/00*** | (2006.01) |
| ***G03G 15/00*** | (2006.01) |
| ***G03G 21/16*** | (2006.01) |

(52) U.S. Cl.

CPC ..... *G03G 15/6529* (2013.01); *G03G 21/16* (2013.01); *G03G 21/1623* (2013.01);

(Continued)

(58) Field of Classification Search

CPC ..... G03G 15/6529; G03G 21/16; G03G 21/1623; G03G 2221/1654; G03G 2221/1684

(Continued)

(56) References Cited

U.S. PATENT DOCUMENTS

| | | | |
|---|---|---|---|
| 5,732,620 | A | 3/1998 | Christy et al. |
| 5,797,068 | A | 8/1998 | Otsuki et al. |

(Continued)

FOREIGN PATENT DOCUMENTS

| | | |
|---|---|---|
| JP | 60111259 | 6/1985 |
| JP | 09-134050 | 5/1997 |

(Continued)

*Primary Examiner* — David Gray
*Assistant Examiner* — Laura Roth
(74) *Attorney, Agent, or Firm* — Nixon & Vanderhye P.C.

(57) ABSTRACT

An image recording apparatus includes a first pullout unit, a second pullout unit, and a first lock mechanism. The first unit is movable along a first axis between a first retracted position where the first unit is fully retracted in the apparatus, and a first exposed position where at least one side surface thereof is fully exposed to the front of the apparatus. The second unit is movable along a second axis, which is perpendicular to the first axis, between a second retracted position where the second unit is fully retracted in the first unit, and a second exposed position where the second unit is exposed to a side of the side surface of the first unit. The first lock mechanism prevents movement of the second unit from the second retracted position to the second exposed position when the first unit is not in the first exposed position.

9 Claims, 9 Drawing Sheets

(52) U.S. Cl.
CPC ..... *G03G 2221/1654* (2013.01); *G03G 2221/1684* (2013.01)

(58) Field of Classification Search
USPC ..... 399/107, 110, 113, 114, 124
See application file for complete search history.

(56) References Cited

U.S. PATENT DOCUMENTS

| | | | |
|---|---|---|---|
| 7,162,182 | B2 | 1/2007 | Tonges et al. |
| 7,272,343 | B2 | 9/2007 | Takahashi et al. |
| 7,418,220 | B2 | 8/2008 | Shiraishi et al. |
| 2007/0092321 | A1 | 4/2007 | Masuda et al. |
| 2007/0104507 | A1 | 5/2007 | Yamanaka et al. |
| 2007/0104530 | A1 | 5/2007 | Tamehira et al. |
| 2008/0260419 | A1 | 10/2008 | Seike et al. |

FOREIGN PATENT DOCUMENTS

| | | |
|---|---|---|
| JP | 2003-047533 | 2/2003 |
| JP | 2004-325662 | 11/2004 |
| JP | 2005-195714 | 7/2005 |
| JP | 2006-145892 | 6/2006 |
| JP | 2007-052276 | 3/2007 |

UNIT PULLING-OUT MECHANISM AND IMAGE RECORDING APPARATUS

This application is a continuation of application Ser. No. 11/819,031, filed Jun. 25, 2007, the entire contents of which are hereby incorporated by reference. This application also claims priority under 35 U.S.C. §119(a) to Japanese Patent Application No. 2006-176745, filed Jun. 27, 2006, the entire contents of which are hereby incorporated by reference.

BACKGROUND OF THE INVENTION

The invention relates to an image recording apparatus for recording an image on paper being transported on a paper transport path; and more particularly to an image recording apparatus provided with a unit pulling-out mechanism for pulling a unit out of the apparatus.

In electrophotographic image recording apparatus, paper is fed from a paper feeding section to an image recording section where an image is formed on the paper. Then the paper is output to a paper output section. Paper jams sometimes occur on a paper transport path leading from the paper feeding section, through the image recording section, to the paper output section. Paper jams are likely to occur particularly in the image recording section. This is because paper tends to be curled while undergoing various processes in the image recording section such as: a developer-image transfer process performed by a transfer device; or a fusing process performed by a fusing device.

Some image recording apparatus are provided with a paper transport path that includes a reversing transport path for use in duplex image formation (an image is formed on both sides of paper). In duplex image formation, paper with an image formed on a first side is reversed in the reversing transport path and transported back to the image recording section. Such a paper transport path has several bifurcations and confluences. Paper jams are likely to occur at the bifurcations and confluences since the transport direction of paper is changed there.

In the event of a paper jam occurring in part of the paper transport path, image recording apparatus stop paper transport throughout the paper transport path, and then suspend an image forming process until all paper sheets present on the paper transport path are removed. JP H09-134050A discloses an image recording apparatus provided with a removable image recording section. The image recording section has openable side walls and can be pulled out to the front side of the apparatus. This arrangement facilitates removal of paper jammed in the image recording section.

In the apparatus, however, only part of the paper transport path located in the image recording section can be exposed by pulling out the section and opening the side walls, and it is therefore difficult to remove jammed paper from unexposed parts of the paper transport path. Also, it is necessary for a user to open all of the side walls to check to see if all paper sheets are removed from the paper transport path.

As a solution to the above-described problems, an image recording apparatus has been proposed that includes: a first pullout unit that can be pulled out to the front of the apparatus; and a second pullout unit that can be pulled out to the lateral side of the apparatus with the first unit pulled out of the apparatus. The first unit has a first transport path, as part of a paper transport path, positioned therein. The second unit has a second transport path, as another part of the paper transport path, positioned therein.

The second transport path is separated from the first transport path by pulling the second unit out of the first unit, so that a large part of each of the first and second paths can be exposed.

When no restriction is imposed on the movement of the first and second units, however, it is impossible to prevent the second unit from being pulled out of the first unit with the first unit not fully pulled out of the apparatus, or the first unit from being inserted into the apparatus with the second unit not fully retracted in the first unit. Thus, the second unit may come into collision with the apparatus and cause malfunctions of, or damage to, the apparatus.

In view of the foregoing, a feature of the invention is to provide an image recording apparatus including a unit pulling-out mechanism that prevents malfunctions of, and damage to, the apparatus by restricting movement of the first and second pullout units in a situation when there is a possibility of the second unit coming into collision with the apparatus.

SUMMARY OF THE INVENTION

An image recording apparatus according to an aspect of the invention includes a first pullout unit, a second pullout unit, and a first lock mechanism. The first pullout unit is movable along a first axis between a first retracted position where the first pullout unit is fully retracted in the apparatus, and a first exposed position where at least one side surface of the first pullout unit is fully exposed to the front of the apparatus. The second pullout unit is movable along a second axis perpendicular to the first axis between a second retracted position where the second pullout unit is fully retracted in the first pullout unit, and a second exposed position where the second pullout unit is exposed to a side of the side surface of the first pullout unit. The first lock mechanism prevents movement of the second pullout unit from the second retracted position to the second exposed position when the first pullout unit is not in the first exposed position. This arrangement allows the second pullout unit to be moved to the side of the side surface of the first pullout unit only when the side surface is fully exposed to the front of the apparatus and thus prevents collision of the second pullout unit with the apparatus when the second pullout unit is moved.

DETAILED DESCRIPTION OF THE INVENTION

With reference to the accompanying drawings, image recording apparatus according to preferred embodiments of the invention will be described below.

Figure 1:
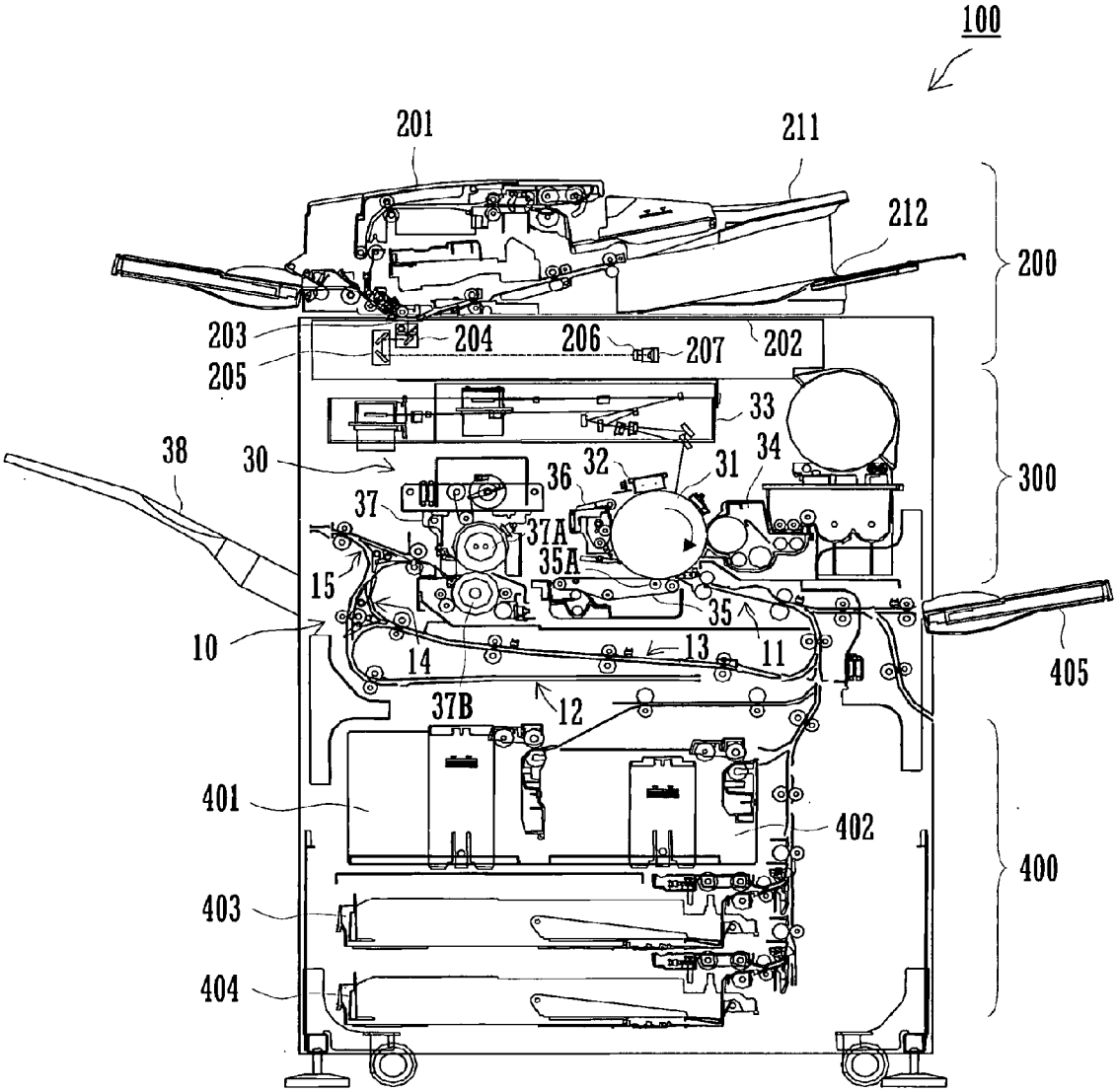
FIG. 1 is a schematic front cross-sectional view of an image recording apparatus according to an embodiment of the invention.

FIG. 1 is a schematic front cross-sectional view of an image recording apparatus, according to a first embodiment of the invention, such as an apparatus 100. The apparatus 100 includes an image reading unit 200, an image forming unit 300, and a paper feeding unit 400.

The unit 200 has an automatic document feeder (ADF) 201, a first document platen 202, a second document platen 203, a first mirror base 204, a second mirror base 205, a lens 206, and a charge coupled device (CCD) 207.

The ADF 201 feeds an original document, sheet by sheet, from a document tray 211 through the platen 203 to a first output tray 212. The ADF 201 is mounted so as to be pivotable about a rear-end pivot between an open position and a closed position. In the closed position, the ADF 201 covers the platen 202. The ADF 201 is pivoted upward to the open position to expose the platen 202, so that a user can place an original document manually on the platen 202.

Each of the platens 202 and 203 includes a hard glass plate.

The bases 204 and 205 are provided below the platens 202 and 203 so as to be movable horizontally. The base 205 moves half as fast as the base 204. On the base 204, a light source and a first mirror are mounted. On the base 205, a second mirror and a third mirror are mounted.

When an image of original document transported by the ADF 201 is to be read, the base 204 is held still below the platen 203. While passing on the platen 203, the original document is irradiated with light from the light source. The reflected light is in turn reflected from the first mirror to the base 205.

When an image of original document placed on the platen 202 is to be read, the bases 204 and 205 are moved horizontally below the platen 202. The document on the platen 202 is irradiated with light from the light source. The reflected light is in turn reflected from the first mirror to the base 205.

Regardless of whether an original document is fed by the ADF 201 or placed on the platen 202, thus, the reflected light from the original document is in turn reflected from the second and third mirrors, and then strikes the CCD 207 through the lens 206.

The CCD 207 outputs electric signals according to an amount of the reflected light from the original document. The electric signals are input to the image forming unit 300 as image data.

The unit 300 is provided with an image recording section 30. The section 30 includes a photoreceptor drum 31, a charging device 32, an exposure device 33, a developing device 34, a transfer belt 35, a cleaner 36, and a fusing device 37.

The drum 31, which has an outer photoreceptive surface, is rotatable in a direction indicated by an arrow. The charging device 32 applies, to the surface of the drum 31, such a voltage as to allow the surface to have a uniform electric potential. The device 32 may be either a noncontact charger, or a contact charger of roller or brush type.

The exposure device 33 irradiates the surface of the drum 31 with light modulated according to image data, so that an electrostatic latent image is formed on the surface. The device 33 has a polygon mirror through which to scan the drum 31 axially with a laser light modulated according to image data. Alternatively, an exposure device provided with an array of light emitting elements such as ELs or LEDs may be used as the device 33.

The developing device 34 supplies toner to the surface of the drum 31 and develops the electrostatic latent image into a toner image.

Under the drum 31, the transfer belt 35 is looped over a plurality of rollers. The belt 35 has a resistance of $1\times10^{9}$ Ω·cm to $1\times10^{13}$ Ω·cm. Inside the loop of the belt 35, a transfer roller 35A is provided so as to be pressed against the drum 31 through the belt 35. A predetermined amount of transfer voltage is applied to the roller 35A, so that a toner image is transferred from the drum 31 to paper that passes between the belt 35 and the drum 31.

The cleaner 36 removes residual toner that remains on the drum 31 after a toner image is transferred from the drum 31 to paper.

The fusing device 37 has a heat roller 37A and a pressure roller 37B. The roller 37A is heated, by an internal heater, to a sufficient temperature to melt toner. The roller 37B is pressed against the roller 37A at a predetermined pressure. The device 37 heats and pressurizes paper passing between the rollers 37A and 37B, thereby firmly fixing a toner image to the paper. After passing through the device 37, the paper is output to a second output tray 38 mounted on a side surface of the apparatus 100. The tray 38 corresponds to the paper output section of the Claims.

The paper feeding unit 400, which corresponds to the paper feeding section according to the Claims, has sheet cassettes 401, 402, 403, and 404, and a manual sheet feeding tray 405. Each of the cassettes 401 to 404 holds a plurality of sheets of paper of the same size. The tray 405 is provided for holding sheets of paper of sizes and types that are used infrequently.

The unit 400 feeds paper, sheet by sheet, from any one of the cassettes 401 to 404 and the tray 405. Paper fed by the unit 400 is transported to the image recording section 30 along a paper transport path 10 to be described below.

Figure 2:
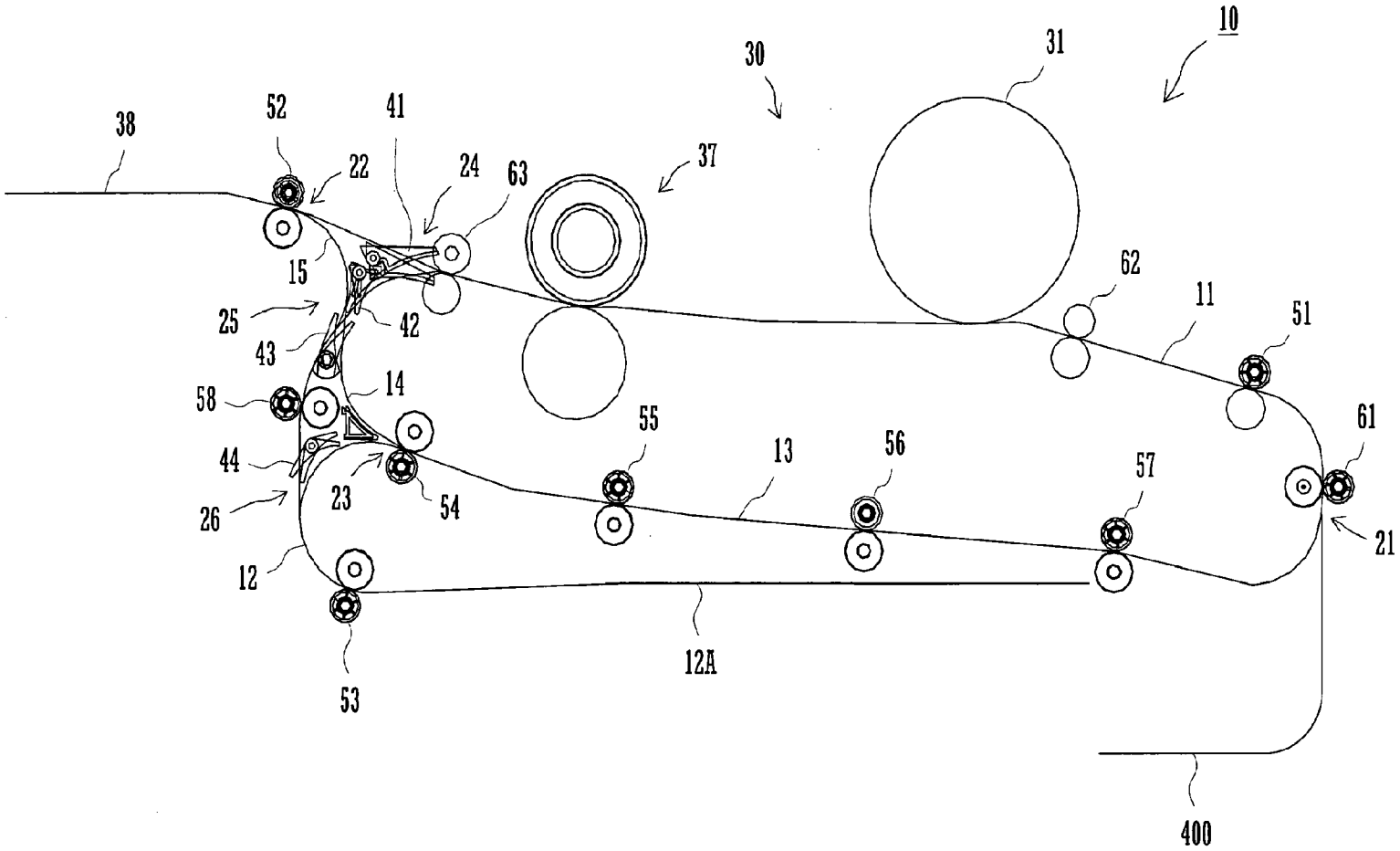
FIG. 2 is a diagram illustrating a configuration of a paper transport path provided in the apparatus.

FIG. 2 is a diagram illustrating a configuration of the paper transport path 10. The path 10 is provided inside the image forming unit 300. The path 10 includes a first path 11, a second path 12, a third path 13, a fourth path 14, and a fifth path 15.

The first path 11 leads from the unit 400 to the tray 38, through a first confluence 21, the section 30, a first bifurcation 24, and a second confluence 22 in that order. Arranged along the path 11 are transport rollers 61, 62, and 63, a registration roller 51, and an output roller 52.

A portion of the path 11 located in the section 30 is in an approximately horizontal position. In the portion, the belt 35 is arranged for stable transfer of toner image from the drum 31 to paper and for stable transport of the paper with an pre-fusion toner image electrostatically attracted thereto.

The first bifurcation 24 is located between the section 30 and the tray 38. The second path 12 leads from the bifurcation 24 to a switchback section 12A, through a second bifurcation 25 and a third bifurcation 26 in that order. The section 12A is located below and parallel to the portion of the path 11 located in the section 30. The section 12A transports paper forwards and backwards therealong. Along the path 12, there are provided reversing rollers 53 and 58.

The third path 13 leads from the third bifurcation 26 to the first confluence 21 through a third confluence 23. The path 13 is located between the section 12A and the portion of the path 11 located in the section 30. Along the path 13, transport rollers 54, 55, 56, and 57 are arranged.

The fourth path 14 leads from the bifurcation 25 to the confluence 23. The fifth path 15 leads from the bifurcation 25 to the confluence 22.

Figure 3:
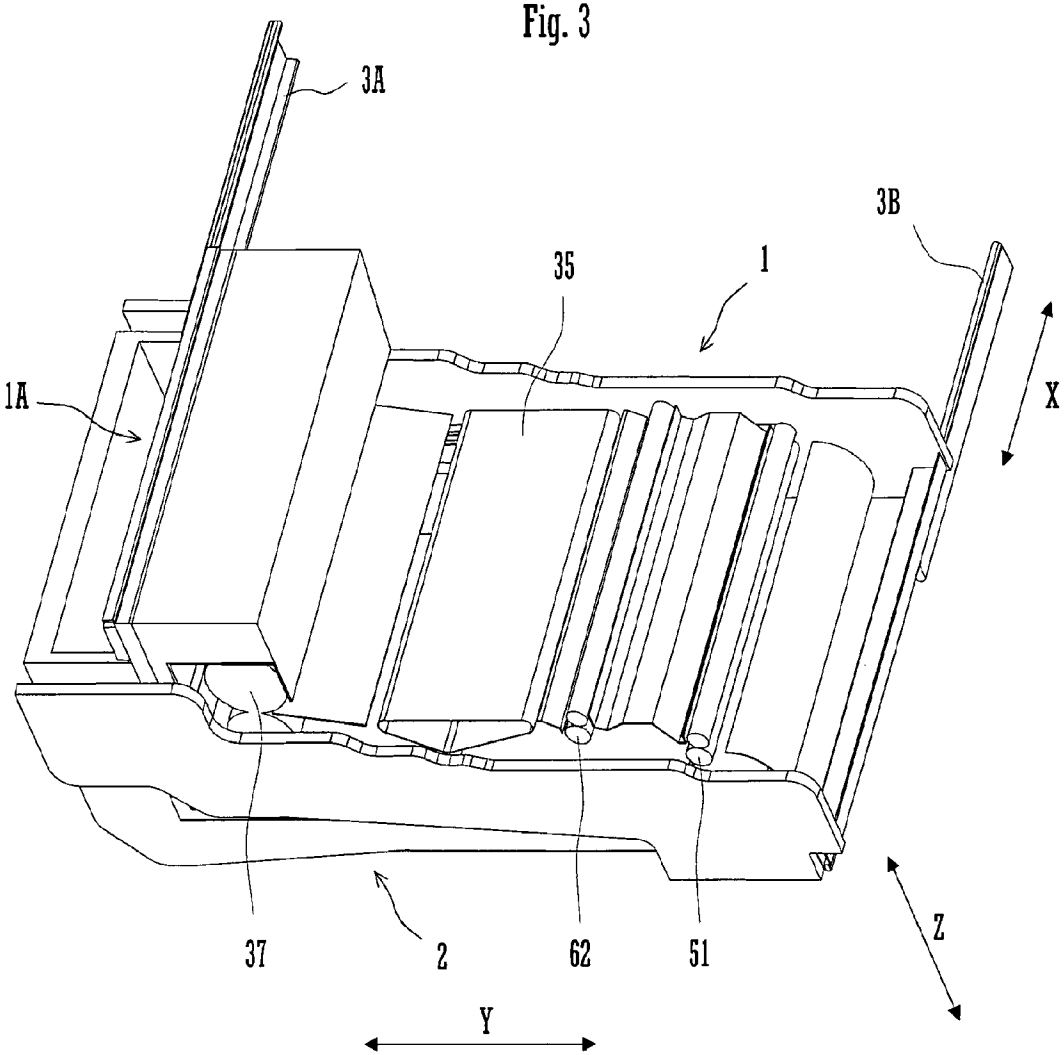
FIG. 3 is an external view of a unit pulling-out mechanism provided in the apparatus.
Figure 4:
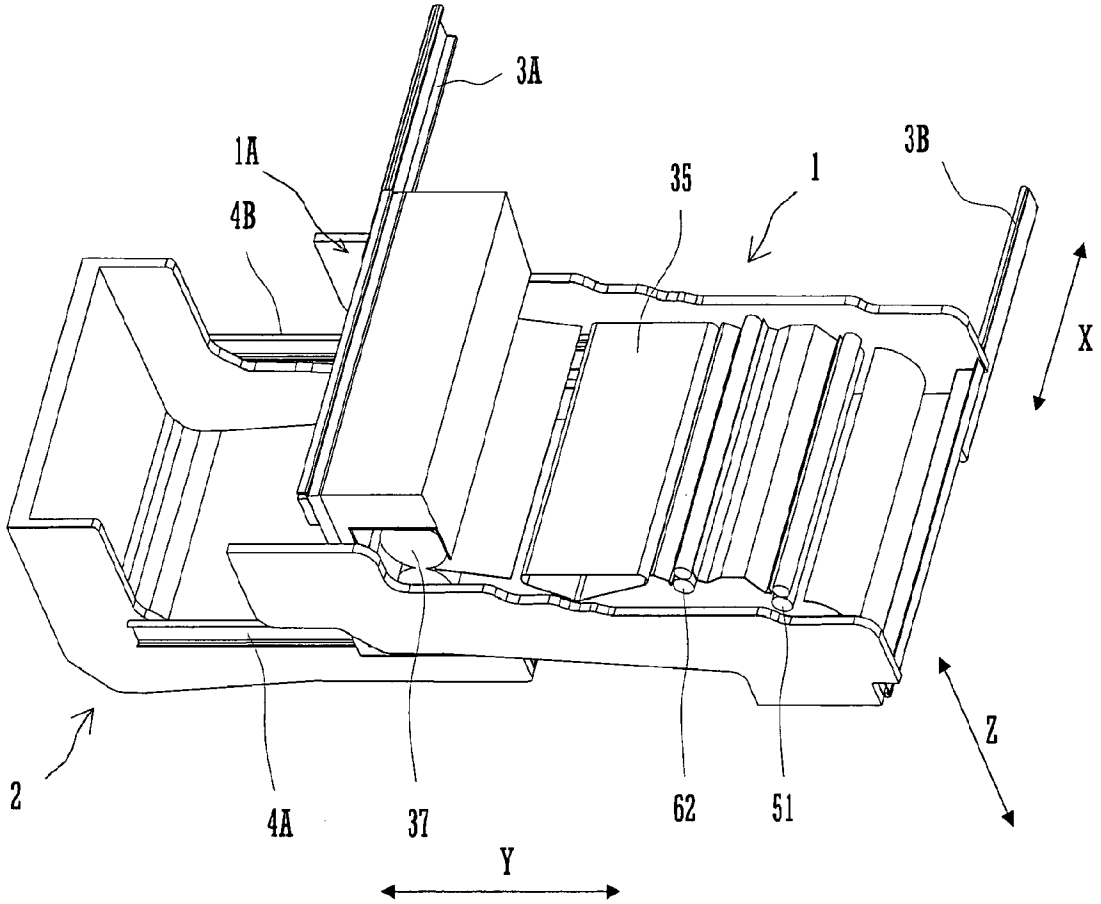
FIG. 4 is another external view of the mechanism.

FIGS. 3 and 4 are external views of a unit pulling-out mechanism according to the embodiment of the invention. FIG. 3 shows a first pullout unit 1 and a second pullout unit 2, both pulled out in front of the apparatus 100. FIG. 4 shows the unit 2 pulled out to the side of the unit 1.

The units 1 and 2 are mounted inside the apparatus 100. In the unit 1, the transfer belt 35, the transfer roller 35A, and the fusing device 37 are positioned. The unit 1 is mounted on the apparatus 100 through sliding rail assemblies 3A and 3B. The assemblies 3A and 3B allow the unit 1 to be moved, along an X-axis as the first axis according to the Claims, between a first retracted position and a first exposed position. In the first retracted position, the unit 1 is fully retracted in the apparatus 100. In the first exposed position, the unit 1 has at least a side surface 1A fully exposed to the front of the apparatus 100.

Figure 5:
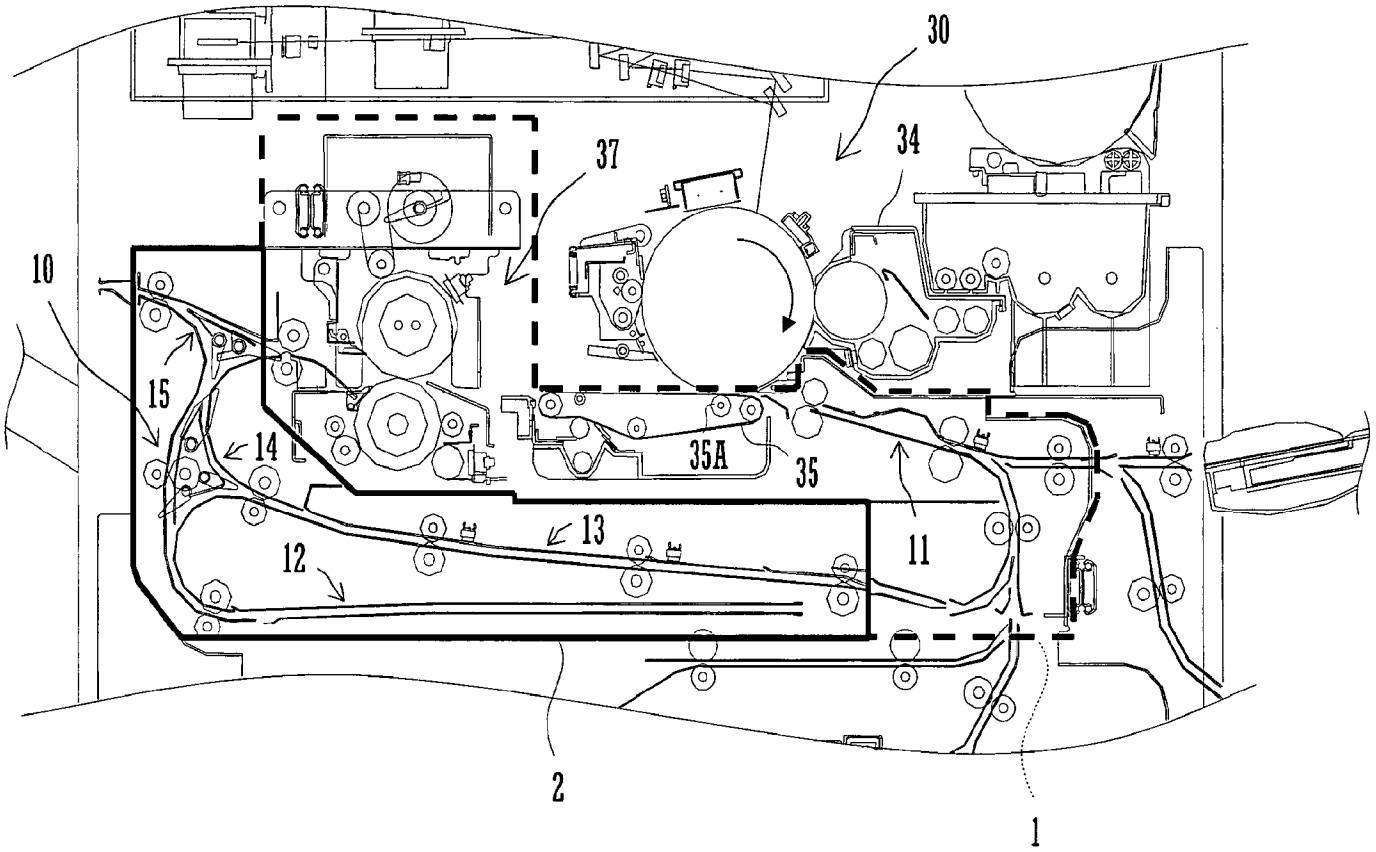
FIG. 5 is a partial enlarged view of the apparatus.

In the unit 1, referring to FIG. 5, the portion of the first path 11 located in the section 30, and a portion of the third path 13, are positioned. These two portions constitute the first transport path according to the Claims. In other words, the first transport path includes the portion of the first path 11 located in the section 30.

When the unit 1 is pulled out from the first retracted position to the first exposed position, the portion of the path 11 located in the section 30 is exposed, as shown in FIG. 3. In the event of a paper jam or the like, thus, a user can easily check to see whether there is any paper remaining in the portion, and, if necessary, remove the remaining paper, by merely pulling the unit 1 out of the apparatus 100.

As an example, a precision ball bearing sliding rail assembly is usable as each of the assemblies 3A and 3B.

In the unit 2, referring also to FIG. 5, a portion of the first path 11, the entire path 12, a portion of the path 13, the entire path 14, and the entire path 15, are positioned. These portions constitute the second transport path according to the Claims. In other words, the second transport path includes the paths 12 and 13, which are positioned parallel to and below the portion of the path 11 located in the section 30.

Referring back to FIG. 4, the unit 2 is mounted on the unit 1 through sliding rail assemblies 4A and 4B. The assemblies 4A and 4B allow the unit 1 to be moved, along the Y-axis, between a second retracted position and a second exposed position. In the second retracted position, the unit 2 is fully retracted in the unit 1. In the second exposed position, the unit 2 is exposed to the side of the side surface 1A. The Y-axis is perpendicular to the X-axis and corresponds to the second axis according to the Claims. As an example, a precision ball bearing sliding rail assembly is usable as each of the assemblies 4A and 4B.

FIGS. 6A to 6D are diagrams illustrating configuration and motion of the assembly 3A. The assembly 3A includes a fixed rail 311, an intermediate rail 312, and a sliding rail 313. With its length parallel to the X-axis, the assembly 3A has a telescopic structure. In other words, the rails 311, 312, and 313 are nested in that order from outside to inside.

The rail 311 is secured to the apparatus 100. In the rail 311, the rail 312 is made movable along the X-axis by a ball bearing (not shown). The rail 313 is attached to the unit 1 and is made movable, along the X-axis, in the rail 312 by a ball bearing (not shown).

The assembly 3A also includes a restricting member. When the assembly 3A is extended, the restricting member prevents movement of the rail 313 in the extension direction until the rail 312 reaches a position fully extended from the rail 311. When the assembly 3A is contracted, the restricting member also prevents movement of the rail 312 in the contraction direction until the rail 313 reaches a position fully retracted in the rail 312.

Figures 6A, 6B, 6C, 6D:
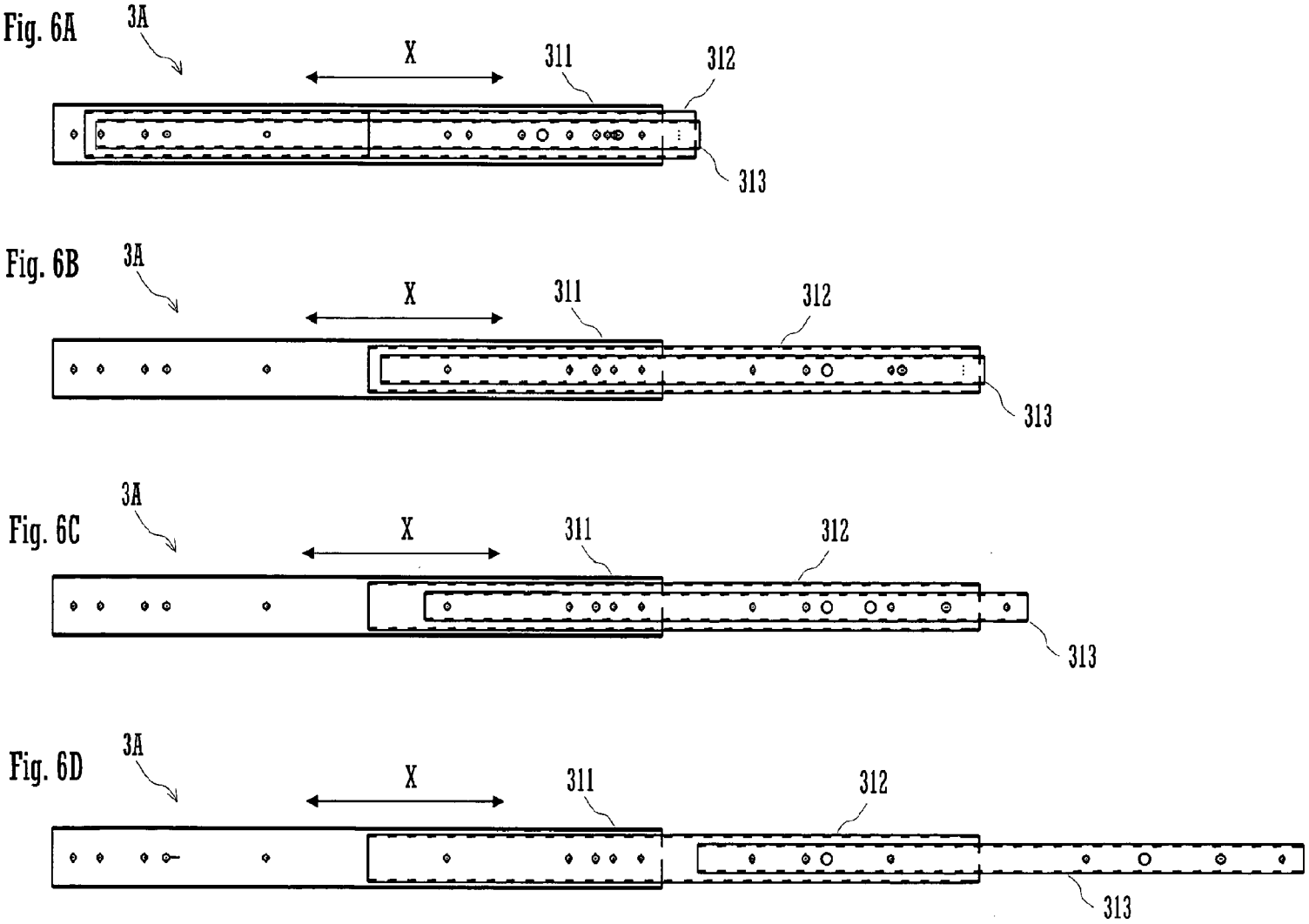
FIGS. 6A to 6D are diagrams illustrating configuration and motion of a sliding rail assembly used in the mechanism.

When the assembly 3A is to be extended from a fully retracted position as shown in FIG. 6A, the rail 312 is first moved to the fully extended position, with the rail 313 fully retracted in the rail 312, as shown in FIG. 6B. Then, the rail 313 is extended from the rail 312, as shown in FIGS. 6C and 6D.

When the assembly 3A is to be contracted from a fully extended position as shown in FIG. 6D, in contrast, the rail 313 is first moved to the fully retracted position, with the rail 312 fully extended from the rail 311, as shown in FIG. 6C. Then, the rail 312 is retracted into the rail 311, as shown in FIG. 6B.

As an example, the blocking member includes a cam member that is provided on the rail 312 so as to move up and down, and a first projection that is formed on the rail 311 for contact with the cam member. When the rail 313 is in the position fully extended from the rail 312, the cam member is in contact with the projection under its own weight, thereby preventing the movement of the rail 312 in the contraction direction. When the rail 313 is in the fully retracted position in the rail 312, in contrast, the cam member is moved to a position out of contact with the projection by a rear end of the rail 313, thereby enabling the movement of the rail 312 in the contraction direction.

The blocking member further includes a second projection that is formed on a surface of the rail 313 facing the rail 312, and a leaf spring that is provided on the rail 312 for elastic engagement with the second projection when the rail 313 is in the fully retracted position. When the assembly 3A is to be extended, the rail 312 is extended from the rail 311 together with the rail 313 due to the engagement between the second projection and the leaf spring. After the rail 312 is fully extended from the rail 311, the rail 313 is extended from the rail 312 by application of a force greater than that of the engagement between the second projection and the leaf spring.

As the assemblies 3A and 3B, thus, any existing sliding rail assemblies are usable that have such a restricting member as to operate as illustrated in FIGS. 6A to 6D.

When the unit 1 is in the first retracted position, the assembly 3A is in the fully contracted position as shown in FIG. 6A. When the unit 1 is being pulled out from the first retracted position to the first exposed position, the rail 313 remains in the fully retracted position in the rail 312 until the rail 312 reaches the position fully extended from the rail 311. After that, when the unit 1 is pulled out further and the rail 312 reaches the position fully extended from the rail 311, the rail 313 is then extended from the rail 312.

When the unit 1 is in the first exposed position, in contrast, the assembly 3A is in the fully extended position as shown in FIG. 6D. When the unit 1 is being pushed from the first exposed position to the first retracted position, the rail 312 is not moved until the rail 313 reaches the fully retracted position in the rail 311. After that, when the unit 1 is pushed further and the rail 313 reaches the fully retracted position in the rail 312, the rail 312 is moved and retracted into the rail 311.

Figure 7A:
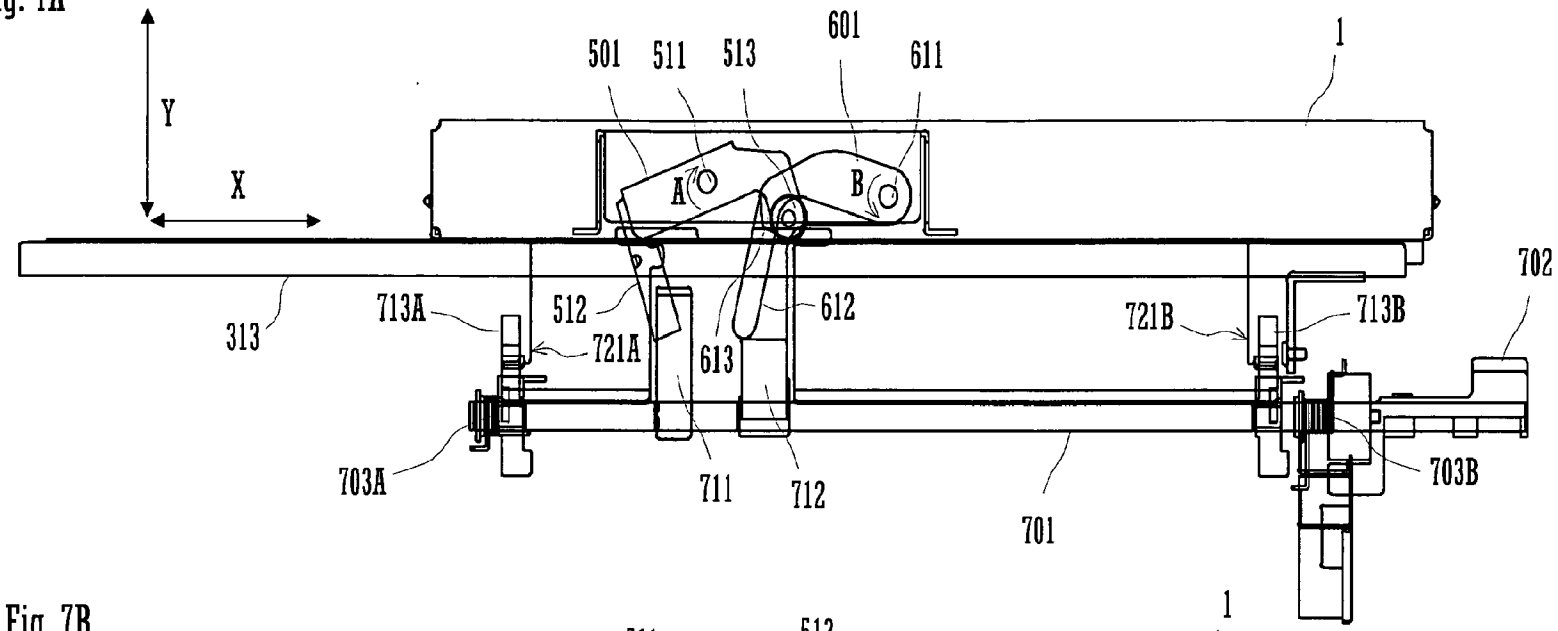
FIGS. 7A and 7B are a plan view and a side view illustrating configurations of a first lock mechanism and a second lock mechanism according to an embodiment of the invention.
Figure 7B:
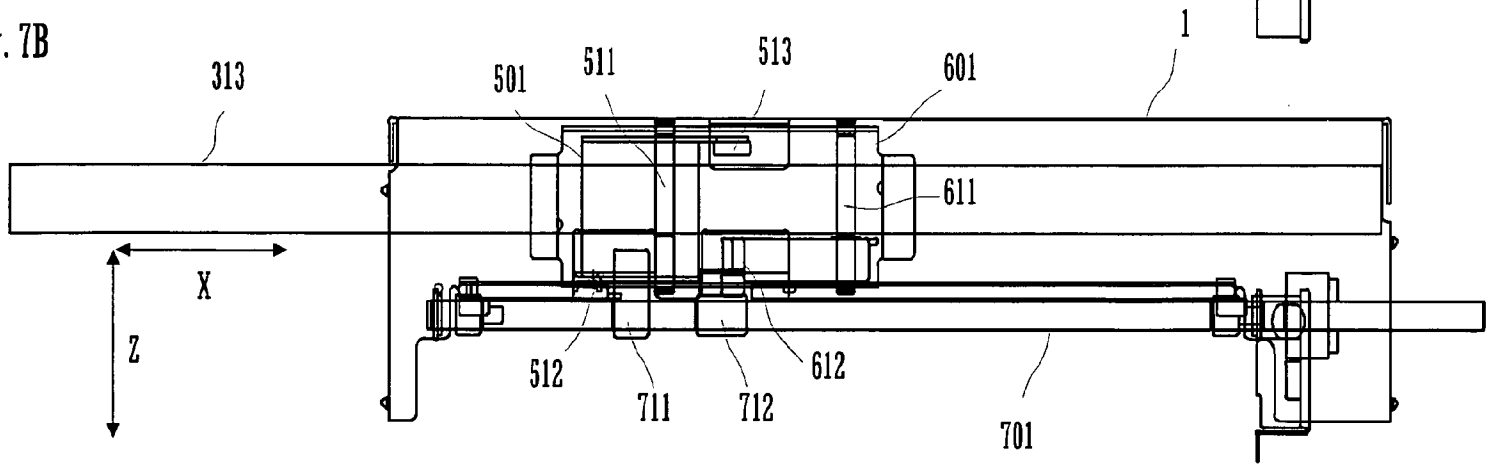

FIGS. 7A and 7B are a plan view and a side view, respectively, illustrating configurations of a first lock mechanism and a second lock mechanism. The unit 2 has a lock shaft 701 mounted rotatably about an axis parallel to the X-axis. The shaft 701 has a release arm 711, a release plate 712, and claws 713A and 713B, mounted on a circumferential surface thereof. Also, the shaft 701 has a handle 702 attached to its front end.

The claws 713A and 713B are for engagement with engagement portions 721A and 721B provided in the unit 1, respectively, when the unit 2 is in the second retracted position. Further, the shaft 701 has coil springs 703A and 703B. Elastic force applied by the springs 703A and 703B urges the shaft 701 in a rotational direction to engage the claws 713A and 713B with the portions 721A and 721B, respectively, from below.

The first lock mechanism of the Claims is configured as a lever 501. The lever 501 is mounted on the unit 1 rotatably about a rotary shaft 511. The shaft 511 is arranged on the Z-axis, which is perpendicular to both of the X- and Y-axes. The lever 501 has a roller 513 rotatably mounted above the rail 313, and a projection 512 provided below the rail 313. The projection 512 is in contact with the arm 711 from above when the unit 1 is not in the first exposed position. The lever 501 is urged in a clockwise direction (i.e., a direction of arrow A) in FIG. 7A by elastic force applied by a spring (not shown).

The second lock mechanism of the Claims is configured as a stopper 601. The stopper 601 is mounted, rotatably about a rotary shaft 611, on the unit 1. The shaft 611 is arranged on the Z-axis. The stopper 601 is provided with a restricting member 613 and a contact member 612, both positioned below the rail 313. The member 612 is to have contact with the release plate 712 when the unit 2 is in the second retracted position.

The member 613 is arranged opposite a lower front end of the rail 312. The stopper 601 is urged in a counterclockwise direction (i.e., a direction of arrow B) in FIG. 7A by elastic force applied by a spring (not shown). When the member 612 is not in contact with the plate 712, i.e., when the unit 2 is not in the second retracted position, the stopper 601 is rotated in the direction of arrow B, thereby bringing the member 613 into contact with the lower front end of the rail 312.

Figure 8A:
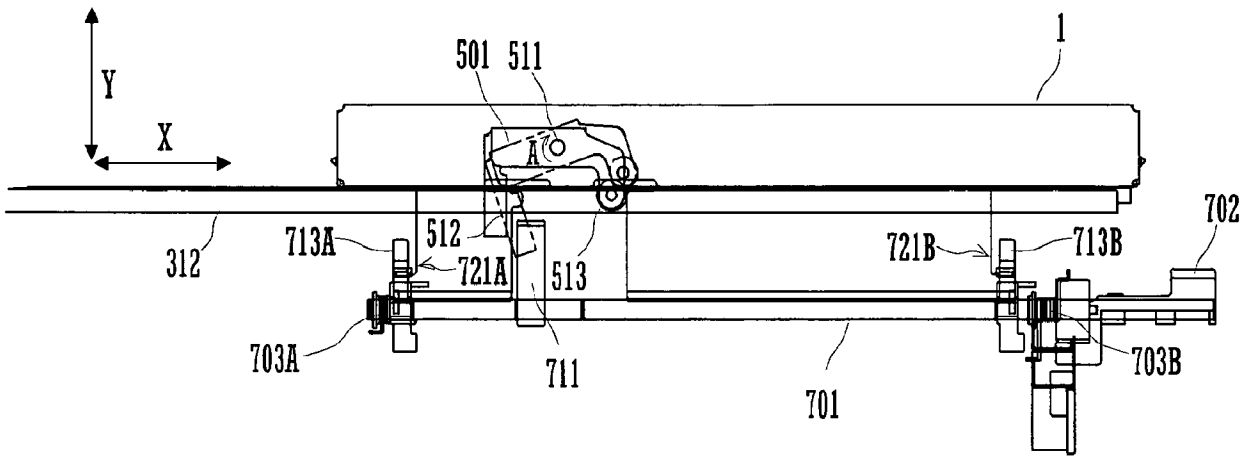
FIGS. 8A and 8B are a plan view and a side view illustrating motion of a lever provided in the first lock mechanism.
Figure 8B:
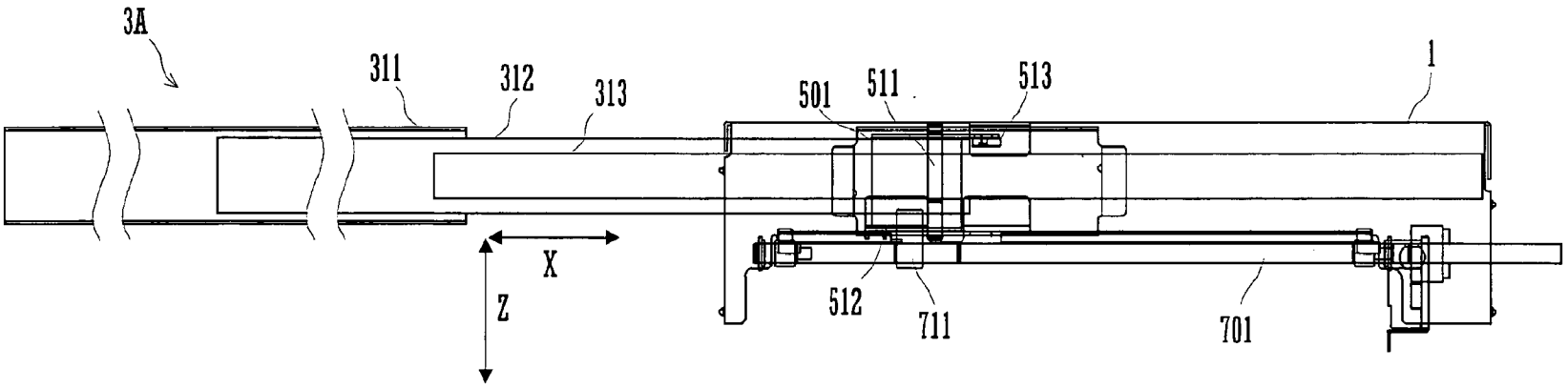

FIGS. 8A and 8B are a plan view and a side view illustrating motion of the lever 501 as the first lock mechanism. When the unit 1 is not in the first exposed position and the rail 313 is in the fully retracted position in the rail 312, a circumferential surface of the roller 513 is in contact with a side of the rail 312.

At this time, the lever 501 is in a position shown by a chain double-dashed line in FIG. 8A, with the arm 711 in contact with an upper surface of the projection 512. The contact between the projection 512 and the arm 711 prevents rotation of the shaft 701 in a direction to move the arm 711 downward, and downward motion of the claws 713A and 713B.

When the unit 1 is not in the first exposed position, thus, the shaft 701 cannot be rotated in the direction to move the claws 713A and 713B downward by operating the handle 702. This maintains engagement of the claws 713A and 713B with the respective portions 721A and 721B and thus prevents the unit 2 from being pulled out of the unit 1 along the Y-axis.

When the unit 1 is being pulled out from the first retracted position to the first exposed position along the X-axis and the rail 312 reaches the position fully extended from the rail 311, the rail 313 is then extended from the rail 312. As the rail 313 is being extended, the roller 513 slides on the side of the rail 312.

When the unit 1 reaches the first exposed position, the roller 513 goes beyond the front end of the rail 312, with the circumferential surface thereof out of contact with the side of the rail 312. Thus, the lever 501 is rotated, in the direction of arrow A, to a position shown by a solid line in FIG. 8A by the elastic force applied by the spring (not shown). This brings the arm 711 out of contact with the upper surface of the projection 512, thereby allowing rotation of the shaft 701 in the direction to move the arm 711 downward and downward motion of the claws 713A and 713B.

When the unit 1 is in the first exposed position, thus, the shaft 701 can be rotated in the direction to move the claws 713A and 713B downward by operating the handle 702. This releases engagement of the claws 713A and 713B with the respective portions 721A and 721B and thus allows the unit 2 to be pulled out of the unit 1 along the Y-axis.

As described above, the lever 501 prevents the movement of the unit 2 from the second retracted position to the second exposed position when the unit 1 is not in the first exposed position. This ensures prevention of the unit 2 from being pulled out of the unit 1 and coming into contact with the apparatus 100 while the unit 1 is being pulled out of the apparatus 100. Therefore, this prevents malfunction of, and damage to, the apparatus 100.

Figure 9A:
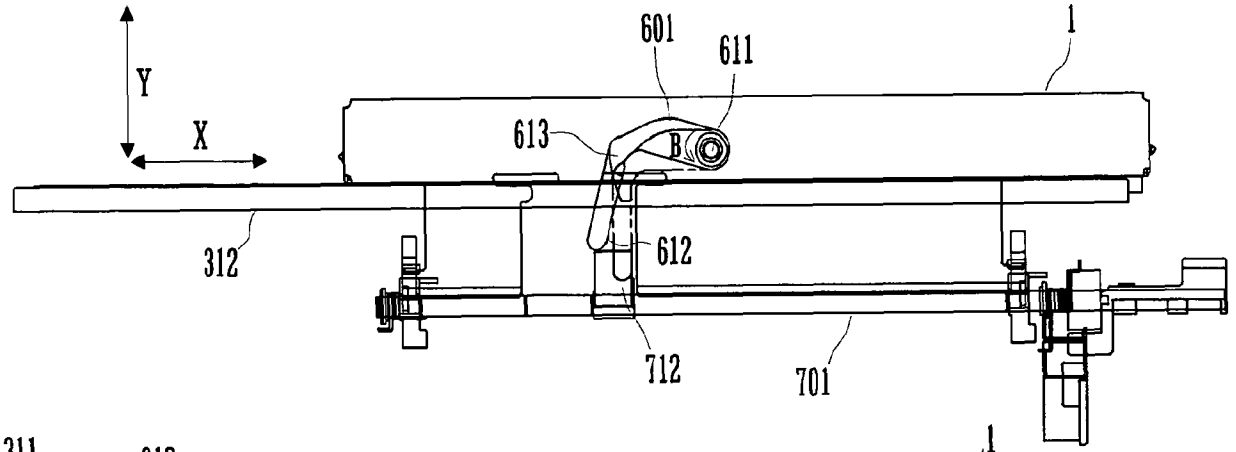
FIGS. 9A and 9B are a plan view and a side view illustrating motion of a stopper provided in the second lock mechanism.
Figure 9B:
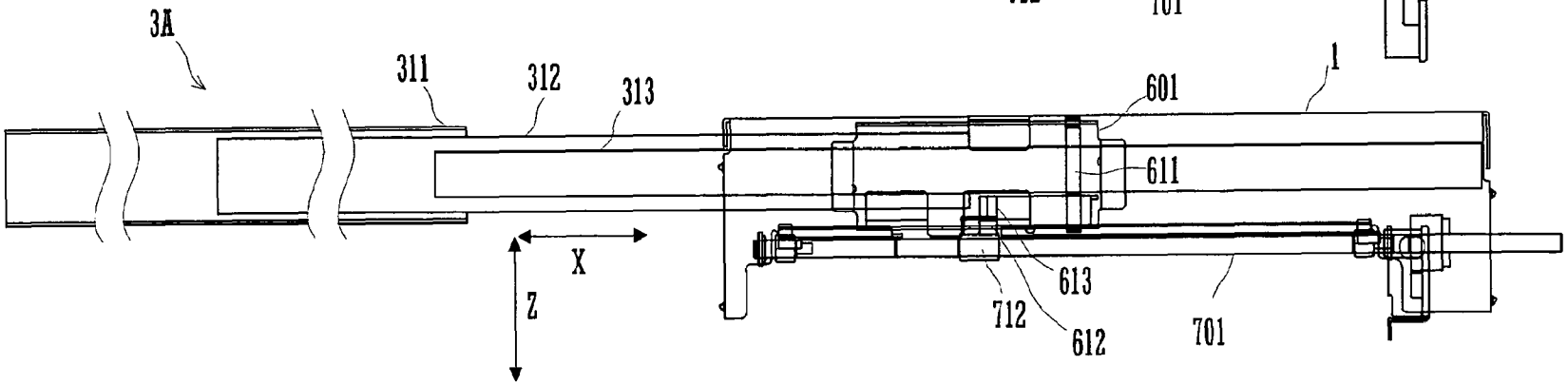

FIGS. 9A and 9B are a plan view and a side view illustrating motion of the stopper 601 provided in the second lock mechanism. When the unit 2 is in the second retracted position, the plate 712 is in contact with the member 612. At this time, the stopper 601 is in a position shown by a solid line in FIG. 9A, with the member 613 out of contact with the lower front end of the rail 312. Thus, the unit 1 is movable along the X-axis. When the unit 2 is in the second retracted position, therefore, the unit 1 can be moved to the first retracted position.

As the unit 2 is being pulled out from the second retracted position to the second exposed position along the Y-axis, the shaft 701 along with the unit 2 is moved away from the assembly 3A, so that the plate 712 is brought out of contact with the member 612. Thus, the stopper 601 is rotated, in the direction of arrow B, to a position shown by a chain double-dashed line in FIG. 9A by the elastic force applied by the spring (not shown), thereby bringing the member 613 into contact with the lower front end of the rail 312.

The unit 1, on which the stopper 601 is mounted, has the rail 313 attached thereto. Thus, the contact between the member 613 and the lower front end of the rail 312 prevents movement of the rail 313 in the direction to retract into the rail 312. When the rail 313 is not in the fully retracted position in the rail 312, the assembly 3A prevents movement of the rail 312 in the contraction direction. Accordingly, when the unit 2 is out of the second retracted position, the unit 1 cannot be moved to the first retracted position.

In the manner as described above, the unit 1 is prevented from being moved from the first exposed position to the first retracted position when the unit 2 is not in the second retracted position. This ensures prevention of the unit 1 from being pushed into the apparatus 100 with the unit 2 pulled out of the unit 1, and of the unit 2 from coming into contact with the apparatus 100. Therefore, this prevents malfunction of, and damage to, the apparatus 100.

The first and second lock mechanisms of the Claims include, but are not limited to, the lever 501 and the stopper 601, respectively, in the embodiment as described above. Any device suffices as the first lock mechanism as long as the device prevents the movement of the unit 2 from the second retracted position to the second exposed position when the unit 1 is not in the first exposed position. Also, any device suffices as the second lock mechanism as long as the device prevents the movement of the unit 1 from the first exposed position to the first retracted position when the unit 1 is not in the second retracted position.

Further, it is not necessary for the apparatus 100 to be provided with both of the first and second lock mechanisms. Provision of at least one of the first and second lock mechanisms reduces the possibility of the unit 2 coming into contact with the apparatus 100 and, therefore, the likelihood of malfunctions of, and damage to, the apparatus 100.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A unit pulling-out mechanism comprising:

a first pullout unit movable in a first direction between a first retracted position and a first exposed position, the first pullout unit being fully retracted in a main apparatus in the first retracted position, the first pullout unit having at least one side surface fully exposed to a front side of the main apparatus in the first exposed position;

a second pullout unit movable in a second direction different from the first direction between a second retracted position and a second exposed position, the second pullout unit being retracted in the first pullout unit in the second retracted position, the second pullout unit being exposed to a side of the one side surface of the first pullout unit in the second exposed position; and a lock mechanism for preventing movement of the second pullout unit from the second retracted position to the second exposed position, the lock mechanism comprising a latching element that holds the second pullout unit in the second retracted position, the latching element being physically blocked from moving to release the second pullout unit from the second retracted position unless the first pullout unit is in the first exposed position such that the second pullout unit cannot move from the second retracted position toward the second exposed position while the first pullout unit moves in the first direction.

2. An image recording apparatus comprising:

the unit pulling-out mechanism as claimed in claim 1;

a paper feeding section for storing paper on which an image is not recorded;

an image recording section for recording an image on paper;

a paper output section for receiving paper on which an image is recorded; and a paper transport path for transporting paper from the paper feeding section, via the image recording section, to the paper output section, wherein the first pullout unit includes a first paper transport path configuring one part of the paper transport path, the second pullout unit includes a second paper transport path configuring another part of the paper transport path.

3. An image recording apparatus comprising:

the unit pulling-out mechanism as claimed in claim 1;

a paper feeding section for storing paper on which an image is not recorded;

an image recording section for recording an image on paper;

a paper output section for receiving paper on which an image is recorded; and a paper transport path for transporting paper from the paper feeding section, via the image recording section, to the paper output section, wherein the second pullout unit includes at least a part of a both sides transport path for transporting paper in the paper transport path.

4. A unit pulling-out mechanism comprising:

a first pullout unit movable in a first direction between a first retracted position and a first exposed position, the first pullout unit being fully retracted in a main apparatus in the first retracted position, the first pullout unit having at least one side surface fully exposed to a front side of the main apparatus in the first exposed position;

a second pullout unit movable in a second direction different from the first direction between a second retracted position and a second exposed position, the second pullout unit being retracted in the first pullout unit in the second retracted position, the second pullout unit being exposed to a side of the one side surface of the first pullout unit in the second exposed position; and a lock mechanism for preventing any movement of the first pullout unit between the first exposed position and the first retracted position unless second pullout unit is in the second retracted position.

5. An image recording apparatus comprising:

the unit pulling-out mechanism as claimed in claim 4;

a paper feeding section for storing paper on which an image is not recorded;

an image recording section for recording an image on paper;

a paper output section for receiving paper on which an image is recorded; and a paper transport path for transporting paper from the paper feeding section, via the image recording section, to the paper output section, wherein the first pullout unit includes a first paper transport path configuring one part of the paper transport path, the second pullout unit includes a second paper transport path configuring another part of the paper transport path.

6. An image recording apparatus comprising:

the unit pulling-out mechanism as claimed in claim 4;

a paper feeding section for storing paper on which an image is not recorded;

an image recording section for recording an image on paper;

a paper output section for receiving paper on which an image is recorded; and a paper transport path for transporting paper from the paper feeding section, via the image recording section, to the paper output section, wherein the second pullout unit includes at least a part of a both sides transport path for transporting paper in the paper transport path.

7. A unit pulling-out mechanism comprising:

a first pullout unit movable in a first direction between a first retracted position and a first exposed position, the first pullout unit being fully retracted in a main apparatus in the first retracted position, the first pullout unit having at least one side surface fully exposed to a front side of the main apparatus in the first exposed position;

a second pullout unit movable in a second direction different from the first direction between a second retracted position and a second exposed position, the second pullout unit being retracted in the first pullout unit in the second retracted position, the second pullout unit being exposed to a side of the one side surface of the first pullout unit in the second exposed position;

a first lock mechanism for preventing movement of the second pullout unit from the second retracted position to the second exposed position, wherein the first lock mechanism is configured such the second pullout unit cannot move from the second retracted position toward the second exposed position while the first pullout unit moves in the first direction; and a second lock mechanism for preventing any movement of the first pullout unit between the first exposed position and the first retracted position unless the second pullout unit is in the second retracted position.

8. An image recording apparatus comprising:

the unit pulling-out mechanism as claimed in claim 7;

a paper feeding section for storing paper on which an image is not recorded;

an image recording section for recording an image on paper;

a paper output section for receiving paper on which an image is recorded; and a paper transport path for transporting paper from the paper feeding section, via the image recording section, to the paper output section, wherein the first pullout unit includes a first paper transport path configuring one part of the paper transport path, the second pullout unit includes a second paper transport path configuring another part of the paper transport path.

9. An image recording apparatus comprising:

the unit pulling-out mechanism as claimed in claim 7;

a paper feeding section for storing paper on which an image is not recorded;

an image recording section for recording an image on paper;

a paper output section for receiving paper on which an image is recorded; and a paper transport path for transporting paper from the paper feeding section, via the image recording section, to the paper output section, wherein the second pullout unit includes at least a part of a both sides transport path for transporting paper in the paper transport path.

* * * * *